US007621348B2

(12) United States Patent
Hoffmaster et al.

(10) Patent No.: US 7,621,348 B2
(45) Date of Patent: Nov. 24, 2009

(54) DRAG BITS WITH DROPPING TENDENCIES AND METHODS FOR MAKING THE SAME

(75) Inventors: Carl M. Hoffmaster, Houston, TX (US); Michael G. Azar, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 11/866,333

(22) Filed: Oct. 2, 2007

(65) Prior Publication Data

US 2008/0105466 A1 May 8, 2008

Related U.S. Application Data

(60) Provisional application No. 60/848,974, filed on Oct. 2, 2006.

(51) Int. Cl.
*E21B 10/43* (2006.01)

(52) U.S. Cl. ..... 175/376; 175/331; 175/398

(58) Field of Classification Search ..... 175/398, 175/331, 376, 397, 76; 76/108.4
See application file for complete search history.

(56) References Cited

U.S. PATENT DOCUMENTS

| | | | |
|---|---|---|---|
| 3,158,216 | A | 11/1964 | Baron et al. |
| 3,344,870 | A | 10/1967 | Morris |
| 4,140,189 | A | 2/1979 | Garner |
| 4,167,980 | A | 9/1979 | Saxman |
| 4,351,401 | A | 9/1982 | Fielder |
| 4,444,281 | A | 4/1984 | Schumacher, Jr. et al. |
| 4,471,845 | A | 9/1984 | Jurgens |
| 4,591,008 | A | 5/1986 | Oliver |

(Continued)

FOREIGN PATENT DOCUMENTS

| | | |
|---|---|---|
| EP | 1096103 | 5/2001 |

(Continued)

OTHER PUBLICATIONS

Combined Search and Examination Report for Appl. No. GB0821536.0 dated Feb. 11, 2009 (4 p.).

(Continued)

*Primary Examiner*—Jennifer H Gay
*Assistant Examiner*—Cathleen R Hutchins
(74) *Attorney, Agent, or Firm*—Conley Rose, P.C.

(57) ABSTRACT

A bit having improved dropping tendencies includes a first plurality of cutters in an active region and a second plurality of cutters in a passive region. The second plurality of cutters has unique radial positions with respect to the first plurality of cutters. The first and the second pluralities of cutters also have cutting tips that extend to the primary cutting profile of the bit. A third plurality of cutters is located in the passive region with cutting tips positioned recessed from the primary cutting profile. A forth plurality of cutters is positioned as back up cutters in the active, region and includes cutters positioned in radial locations such that they overlap, when viewed in rotated profile, with cutters in the third plurality of cutters. The fourth plurality of cutters has cutting tips positioned to extend to the primary cutting profile. The cutters on the bit are arranged such that an imbalance force vector exists on the bit when used to drill though earth formation.

36 Claims, 6 Drawing Sheets

U.S. PATENT DOCUMENTS

| | | | | |
|---|---|---|---|---|
| 4,602,691 | A | 7/1986 | Weaver | |
| 4,932,484 | A | 6/1990 | Warren et al. | |
| 4,936,398 | A | 6/1990 | Auty et al. | |
| 4,991,670 | A | 2/1991 | Fuller et al. | |
| 5,010,783 | A | 4/1991 | Sparks et al. | |
| 5,064,007 | A | 11/1991 | Kaalstad | |
| 5,074,367 | A | 12/1991 | Estes | |
| 5,099,929 | A * | 3/1992 | Keith et al. | 175/61 |
| 5,109,935 | A | 5/1992 | Hawke | |
| 5,145,016 | A | 9/1992 | Estes | |
| 5,145,017 | A | 9/1992 | Holster et al. | |
| 5,186,268 | A | 2/1993 | Clegg | |
| 5,222,566 | A | 6/1993 | Taylor et al. | |
| 5,238,075 | A | 8/1993 | Keith et al. | |
| 5,244,039 | A | 9/1993 | Newton, Jr. et al. | |
| 5,289,889 | A | 3/1994 | Gearhart et al. | |
| 5,407,024 | A | 4/1995 | Watson et al. | |
| 5,456,141 | A | 10/1995 | Ho | |
| 5,494,123 | A | 2/1996 | Nguyen | |
| 5,531,281 | A * | 7/1996 | Murdock | 175/431 |
| 5,549,171 | A | 8/1996 | Mensa-Wilmot et al. | |
| 5,551,522 | A | 9/1996 | Keith et al. | |
| 5,553,581 | A | 9/1996 | Hirabayashi et al. | |
| 5,553,681 | A | 9/1996 | Huffstutler et al. | |
| 5,575,301 | A | 11/1996 | Bolton | |
| 5,582,261 | A | 12/1996 | Keith et al. | |
| 5,592,996 | A | 1/1997 | Keith et al. | |
| 5,607,024 | A | 3/1997 | Keith et al. | |
| 5,607,025 | A | 3/1997 | Mensa-Wilmot et al. | |
| 5,608,162 | A | 3/1997 | Ho | |
| 5,651,421 | A | 7/1997 | Newton et al. | |
| 5,697,462 | A | 12/1997 | Grimes et al. | |
| 5,709,278 | A | 1/1998 | Crawford | |
| 5,746,280 | A | 5/1998 | Scott et al. | |
| 5,755,301 | A | 5/1998 | Love et al. | |
| 5,803,196 | A | 9/1998 | Fielder | |
| 5,816,346 | A | 10/1998 | Beaton | |
| 5,839,526 | A | 11/1998 | Cisneros et al. | |
| 5,862,871 | A | 1/1999 | Curlett | |
| 5,890,550 | A | 4/1999 | Swadi et al. | |
| 5,937,958 | A | 8/1999 | Mensa-Wilmot et al. | |
| 5,979,577 | A | 11/1999 | Fielder | |
| 5,996,713 | A | 12/1999 | Pessier et al. | |
| 6,021,859 | A | 2/2000 | Tibbitts et al. | |
| 6,123,160 | A | 9/2000 | Tibbitts | |
| 6,123,161 | A * | 9/2000 | Taylor | 175/397 |
| 6,164,394 | A * | 12/2000 | Mensa-Wilmot et al. | 175/331 |
| 6,173,797 | B1 | 1/2001 | Dykstra et al. | |
| 6,227,314 | B1 | 5/2001 | Zadrapa et al. | |
| 6,283,233 | B1 | 9/2001 | Lamine et al. | |
| 6,308,790 | B1 | 10/2001 | Mensa-Wilmot et al. | |
| 6,349,780 | B1 * | 2/2002 | Beuershausen | 175/408 |
| 6,408,958 | B1 | 6/2002 | Isbell et al. | |
| 6,427,792 | B1 | 8/2002 | Roberts et al. | |
| 6,481,511 | B2 | 11/2002 | Matthias et al. | |
| 6,536,543 | B2 | 3/2003 | Meiners et al. | |
| 6,575,256 | B1 | 6/2003 | Doster | |
| 6,615,934 | B2 | 9/2003 | Mensa-Wilmot | |
| 6,659,199 | B2 | 12/2003 | Swadi | |
| 6,684,410 | B2 | 2/2004 | Singh et al. | |
| 6,711,969 | B2 | 3/2004 | Meiners et al. | |
| 6,834,733 | B1 | 12/2004 | Maouche et al. | |
| 6,883,623 | B2 | 4/2005 | McCormick et al. | |
| 7,025,156 | B1 | 4/2006 | Caraway | |
| 7,278,499 | B2 | 10/2007 | Richert et al. | |
| 2002/0020565 | A1 | 2/2002 | Hart et al. | |
| 2002/0121393 | A1 | 9/2002 | Thigpen et al. | |
| 2006/0162968 | A1 * | 7/2006 | Durairajan et al. | 175/431 |
| 2006/0185901 | A1 | 8/2006 | Sinor et al. | |
| 2006/0260845 | A1 | 11/2006 | Johnson | |
| 2007/0079995 | A1 | 4/2007 | McClain et al. | |
| 2007/0093996 | A1 * | 4/2007 | Cariveau et al. | 703/7 |
| 2007/0240905 | A1 | 10/2007 | Mensa-Wilmot | |
| 2007/0261890 | A1 * | 11/2007 | Cisneros | 175/331 |
| 2007/0272445 | A1 * | 11/2007 | Cariveau et al. | 175/331 |
| 2008/0135297 | A1 | 6/2008 | Gavia | |

FOREIGN PATENT DOCUMENTS

| | | |
|---|---|---|
| GB | 2294712 | 5/1996 |
| GB | 2301852 | 12/1996 |
| GB | 2309242 | 7/1997 |
| GB | 2317195 | 3/1998 |
| GB | 2329203 | 3/1999 |
| GB | 2349661 | 8/2000 |
| GB | 2357534 | 6/2001 |
| GB | 2378718 | 2/2003 |
| GB | 2393982 | 4/2004 |
| GB | 2417967 | 3/2006 |
| GB | 2438053 | 11/2007 |
| GB | 2450222 | 12/2008 |
| WO | 2007098159 | 8/2007 |
| WO | 2008073309 | 6/2008 |

OTHER PUBLICATIONS

Baker Hughes Christenson; Quantec Performance Update; 2008 (pp. 10).
Baker Hughes Christenson; Quantec Bit; (pp. 1).
Baker Hughes Christensen; Quantec; Premium PDC drill bits; (pp. 1).
Baker Hughes Christensen; Quantec Brochure, 2008; (pp. 8).
Halliburton; Drilling, Evaluation and Gidital Solutions; Security DBS DrillBits; 2007; (pp. 2).
Office Action Dated Jan. 24, 2008 for U.S. Appl. No. 11/382,510; (20 p.).
Response to Office action Dated Jan. 24, 2008 for U.S. Appl. No. 11/382,510; (18 p.).
Final Office Action Dated Aug. 25, 2008 for U.S. Appl. No. 11/382,510; (9 p.).
Response to Final Office Action Dated Aug. 25, 2008 for U.S. Appl. No. 11/382,510; (15 p.).
Office Action Dated Feb. 10, 2009 for U.S. Appl. No. 11/382,510; (12 p.).
Office Action dated Jul. 9, 2008 for U.S. Appl. No. 11/760,933; (16 p.).
Response to Office Action Dated Jul. 9, 2008 for U.S. Appl. No. 11/760,933; (25 p.).
Final Office Action Dated Jan. 23, 2009 for U.S. Appl. No. 11/760,933; (24 p.).
Response to Final Office Action Dated Jan. 23, 2009 for U.S. Appl. No. 11/760,933; (19 p.).
Advisory Action Dated Apr. 2, 2009 for U.S. Appl. No. 11/760,933; (3 p.).
Canadian Office Action dated Mar. 9, 2009 for U.S. Appl. No. 2,587,287; (3 p.).
Combined Search and Examination Report for Appl. No. GB0708446.0 dated Aug. 9, 2007; (2 p.).
Examination Report for Appl. No. GB0708446.0 dated Nov. 14, 2008; (2 p.).
Combined Search and Examination Report for Appl. No. GB0810112.3 dated Jul. 29, 2008; (4 p.).
Combined Search and Examination Report for Appl. No. GB0822293.7 dated Apr. 17, 2009; (4 p.).
Combined Search and Examination Report for Appl. No. GB0821536.0 dated Feb. 11, 2009; (2 p.).
Combined Search and Examination Report for Appl. No. GB0719244.6 dated Jan. 23, 2008; (3 p.).

* cited by examiner

DRAG BITS WITH DROPPING TENDENCIES AND METHODS FOR MAKING THE SAME

CROSS-REFERENCE TO RELATED APPLICATIONS

This application claims the benefit under 35 U.S.C. §119 (e) of U.S. Provisional Patent Application No. 60/848,974, filed on (Oct. 2, 2006, titled "Drag Bits with Dropping Tendencies and Methods for Making the Same," which is now incorporated herein by reference.

STATEMENT REGARDING FEDERALLY SPONSORED RESEARCH OR DEVELOPMENT

Not applicable.

BACKGROUND OF INVENTION

1. Field of the Invention

The present invention relates generally to drill bits and more generally to a bit designed to shift orientation in a predetermined direction as it drills. Even more particularly, the preferred embodiment relates to a drill bit having inclination reducing or dropping tendencies.

2. Background Art

Drill bits, in general, are well known in the art. The bit is attached to the lower end of the drill string and is typically rotated by rotating the drill string at the surface or by a downhole motor, or by both methods. The bit is typically cleaned and cooled during drilling by the flow of drilling fluid out of one or more nozzles on the bit face. The fluid is pumped down the drill string, flows across the bit face, removing cuttings and cooling the bit, and then flows back to the surface through the annulus between the drill string and the borehole wall.

The cost of drilling a borehole is proportional to the length of time it takes to drill the borehole to the desired depth and location. The drilling time, in turn, is greatly affected by the number of times the drill bit must be changed in order to reach the targeted depth or formation. This is the case because each time the bit is changed the entire drill string, which may be miles long, must be retrieved from the borehole, section by section. Once the drill string has been retrieved and the new bit installed, the new bit must be lowered to the bottom of the borehole on the drill string, which again must be constructed section by section. This process, known as a "trip" of the drill string, requires considerable time, effort and expense. Accordingly, it is always desirable to minimize the number of trips that must be made in a given well.

In recent years a majority of bits have been designed using hard polycrystalline diamond compacts (PDC) as cutting or shearing elements. The cutting elements or cutters are mounted on a rotary bit and oriented so that each PDC engages the rock face at a desired angle. The PDC bit has become an industry standard for cutting formations of grossly varying hardnesses. The cutting elements used in such bits are formed of extremely hard materials and include a layer of polycrystalline diamond material. In the typical PDC bit, each cutter element or assembly comprises an elongate and generally cylindrical support member which is received and secured in a pocket formed in the surface of the bit body. A cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide. As used herein, reference to a "PDC" bit or "PDC" cutting element includes superabrasive materials such as polycrystalline diamond, cubic boron nitride, thermally stable diamond, polycrystalline cubic boron nitride, or ultrahard tungsten carbide.

The configuration or layout of the PDC cutters on a bit face varies widely, depending on a number of factors. One of these is the formation itself, as different cutting element layouts cut the various strata differently. In running a bit, the driller may also consider weight on bit, the weight and type of drilling fluid, and the available or achievable operating regime. Additionally, a desirable characteristic of the bit is that it be "stable" and resist vibration, the most severe type or mode of which is "whirl," which is a term used to describe the phenomenon wherein a drill bit rotates about an axis that is offset from the geometric center of the drill bit. Whirling subjects the cutting elements on the bit to increased loading, which may cause the premature wearing or destruction of the cutting elements and a loss of penetration rate. Alternatively, U.S. Pat. Nos. 5,109,935 and 5,010,789 disclose techniques for reducing whirl by compensating for imbalance in a controlled manner, the contents of which are hereby incorporated by reference. In general, optimization of cutter placement and orientation and overall design of the bit have been the objectives of extensive research efforts.

Directional and horizontal drilling have also been the subject of much research. Directional and horizontal drilling involves deviation of the borehole from vertical. Frequently, this drilling program results in boreholes whose remote ends are approximately horizontal. Advancements in measurement while drilling (MWD) technology have made it possible to track the position and orientation of the wellbore very closely. At the same time, more extensive and more accurate information about the location of the target formation is now available to drillers as a result of improved logging techniques and methods, such as geosteering. These increases in available information have raised the expectations for drilling performance. For example, a driller today may target a relatively narrow, horizontal oil-bearing stratum, and may wish to maintain the borehole within the stratum once the borehole has entered the stratum. In more complex scenarios, highly specialized "design drilling" techniques are preferred, with highly tortuous well paths having multiple directional changes of two or more bends lying in different planes.

A common way to control the direction in which the bit is drilling is to steer using a turbine, downhole motor with a bent sub and/or housing. As shown in FIG. 1, a simplified version of a downhole steering system according to the prior art comprises a rig 1, drill string 2 having a motor 6 with or without a bent sub 4, and drill bit 8. The motor 6, with or without a bent sub 4, forms part of the bottom hole assembly (BHA). These BHA components are attached to the lower end of the drill string 2 adjacent the bit 8. When not rotating, the bent sub 4 causes the bit face to be canted with respect to the tool axis. The motor is capable of converting fluid pressure from drilling fluid pumped down the drill string into rotational energy at the bit. This presents the option of rotating the bit without rotating the drill string. When a downhole motor is used with a bent housing and the drill string is not rotated, the rotating action of the motor normally causes the bit to drill a hole that is deviated in the direction of the bend in the housing. When the drill string is rotated, the borehole normally maintains direction, regardless of whether a downhole motor is used, as the bent housing rotates along with the drill string and thus no longer orients the bit in a particular direction. Hence, a bent housing and downhole motor are effective for deviating a borehole.

When a well is substantially deviated by several degrees from vertical and has a substantial inclination, such as by more than 30 degrees, the factors influencing drilling and steering change as compared to those of a vertical well. This change in factors reduces operational efficiency for a number of reasons.

First, operational parameters such as weight on bit (WOB) and RPM have a large influence on the bit's rate of penetration, as well as its ability to achieve and maintain the required well bore trajectory. As the well's inclination increases and approaches horizontal, it becomes much more difficult to apply weight on bit effectively, as the well bottom is no longer aligned with the force of gravity. Furthermore, the increasing bend in the drill string means that downward force applied to the string at the surface is less likely to be translated into WOB, and is more likely to increase loading that can cause the buckling or deforming of the drill string. Thus, attempting to steer with a downhole motor and a bent sub normally reduces the achievable rate of penetration (ROP) of the operation, and makes tool phase control very difficult.

Second, using the motor to change the azimuth or inclination of the well bore without rotating the drill string, a process commonly referred to as "sliding," means that the drilling fluid in most of the length of the annulus is not subject to the rotational shear that it would experience if the drill string were rotating. Drilling fluids tend to be thixotropic, so the loss of this shear adversely affects the ability of the fluid to carry cuttings out of the hole. Thus, in deviated holes that are being drilled with the downhole motor alone, cuttings tend to settle on the bottom or low side of the hole. This increases borehole drag, making weight-on-bit transmission to the bit very difficult and causing problems with tool phase control and prediction. This difficulty makes the sliding operation very inefficient and time consuming Third, drilling with the downhole motor alone during sliding deprives the driller of the advantage of a significant source of rotational energy, namely the surface equipment that would otherwise rotate the drill string and reduce borehole drag and torque. The drill string, which is connected to the surface rotation equipment, is not rotated during drilling with a downhole motor during sliding. Additionally, drilling with the motor alone means that a large fraction of the fluid energy is consumed in the form of a pressure drop across the motor in order to provide the rotational energy that would otherwise be provided by equipment at the surface. Thus, when surface equipment is used to rotate the drill string and the bit, significantly more power is available downhole and drilling is faster. This power can be used to rotate the bit or to provide more hydraulic energy at the bit face, for better cleaning and faster drilling.

In addition to the directional drilling described in the discussion of FIG. 1, it is also desirable to have a drill bit that is capable of returning to a vertical drilling orientation (without the aid of an external steering mechanism such as turbine or bent sub) should the bit inadvertently deviate from vertical. The ability of a bit to return to a vertical path after deviating from such a path is known in the art as "dropping". In order to effect dropping, such a drill bit must also have the capability of drilling or penetrating the earth in a direction that is not parallel with the longitudinal axis of the bit. It is therefore desirable to have cutting elements on the side of the bit to allow for such cutting action.

As shown in the schematic view of FIG. 2, a drill string assembly 50 consisting of a drill string 53 and a bit 51, is shown drilling a borehole 55 that has deviated from vertical. Drill string assembly 50 has a weight vector 52 that consists of an axial component 54 and a normal component 56. Unlike the directional drilling operations described above, such deviations from vertical are sometimes unintentional, and it is desirable in many instances to return drilling assembly 50 to a vertical orientation while drilling. In such a case, it is necessary for drill bit 51 to drill in a direction that is not parallel to axial vector 54 when the borehole has deviated from a desired vertical position. This can be accomplished by removing material from a side wall 57, rather than just a bottom portion 58, of borehole 55. As explained in more detail below, the ability to remove material from side wall 57 in a deviated borehole is enhanced when a bit 51 generates increased forces parallel to normal component 56 during operation.

In recent years, drill bits with asymmetric blade designs have been proposed and used in directional applications to generate forces during drilling that are not parallel to the axial vector 54 in a deviated well. Conventionally, these designs include "active" regions wherein cutters are positioned on blades of a bit to extend and form a primary cutting profile of the bit, and "passive" regions wherein cutters on selected blades of the bit are positioned to be recessed from the primary cutting profile formed by the active cutters. This arrangement leads to increased loading on the "active" side of the bit which results in off-axis forces that enhance the dropping tendencies of the bit. This also reduces the tendencies of the bit to whirl. However, as these bits are being pushed to drill longer segments through earth formation, it has been found that recessing the cutters on a passive side of a bit design may also lead to reduced durability and limited bit life. This is due to a reduction of the number of active cutters on the bit which result in increased loading on the remaining active cutters. The passive cutters pulled off profile generally do not actively drill the formation until the active cutters have undergone significant wear. As a result, excessive cutter wear may be seen on cutters and blades in the active regions of the bit. Cutter breakage and/or premature cutter loss may also occur in the cone and nose region before a desired drilling depth is reached.

Accordingly, an improved directional drilling bit is desired that allows for off-axis drilling in a deviated well by exerting a force against the side of the borehole and increased durability and bit life.

SUMMARY OF INVENTION

In one aspect, the invention provides a bit having improved dropping tendencies. The bit includes additional cutters placed in the active region to compensate for cutting elements in the passive region that are pulled off profile to produce an imbalance force on the bit.

In one embodiment, a bit includes a first plurality of cutters in an active region and a second plurality of cutters in a passive region. The second plurality of cutters has unique radial positions with respect to the first plurality of cutters. The first and the second pluralities of cutters also have cutting tips that extend to the primary cutting profile of the bit. A third plurality of cutters is located in the passive region with cutting tips positioned recessed from the primary cutting profile. A forth plurality of cutters is positioned as back up cutters in the active region behind the first plurality of cutters and includes cutters positioned in radial locations such that they overlap, when viewed in rotated profile, with cutters in the third plurality of cutters. The fourth plurality of cutters has cutting tips positioned to extend to the primary cuffing profile. The first, second, third, and fourth pluralities of cutters are positioned on the bit such that an imbalance force vector exists on the bit when it is used to drill though earth formation.

In another embodiment, a bit includes a first arrangement of cutters on a first blade with cutting tips extending to a primary cutting profile, and a second arrangement of cutters on a second blade including a first plurality of cutters with cutting tips extending to the primary cutting profile and a second plurality of cutters with cutting tips recessed from the primary cutting profile. A third arrangement of cutters is also disposed on the first blade behind the first arrangement. The third arrangement includes a third plurality of cutters having cutting tips extending to the primary cutting profile at radial locations generally corresponding to radial locations of the second plurality of cutters such that in rotated profile the third plurality of cutters overlaps with the second plurality of cutters.

These and other aspects of the present invention will be apparent from the following description, figures, and the appended claims.

DETAILED DESCRIPTION

Figure 1:
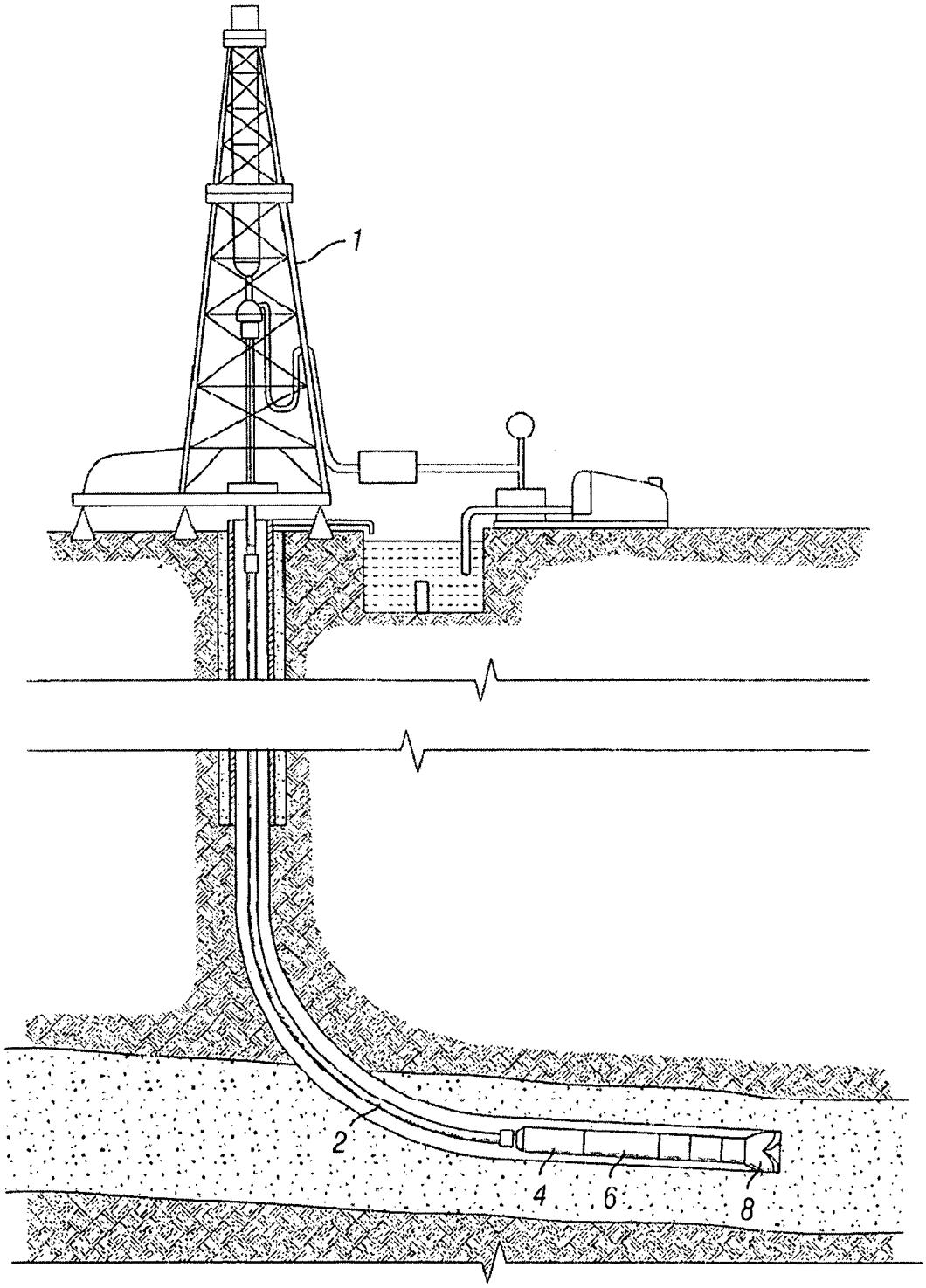
FIG. 1 (Prior Art)
FIG. 1 shows a conventional drilling system.
Figure 2:
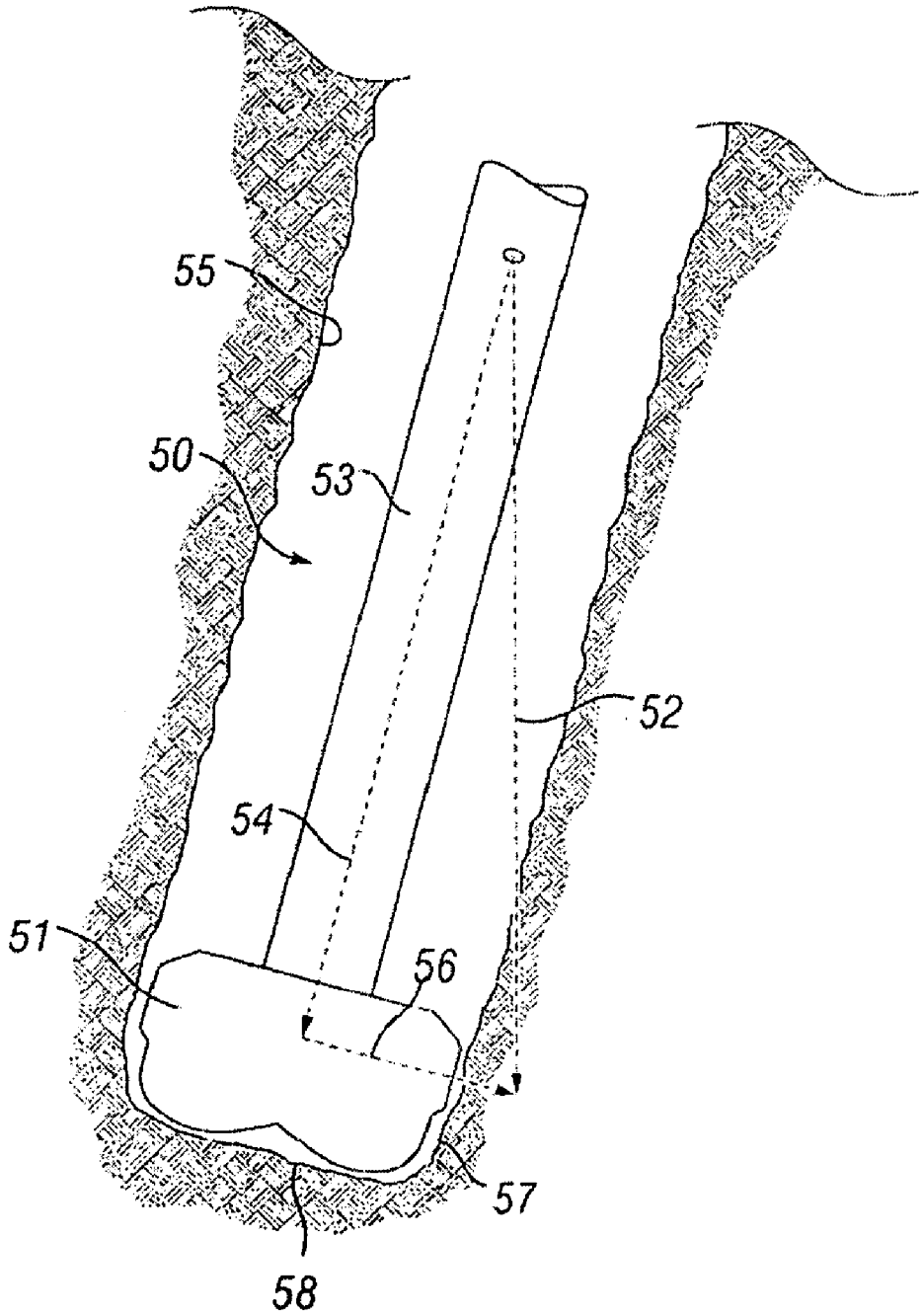
FIG. 2 (Prior Art)
FIG. 2 is a schematic view of a conventional drill bit on a drill string.
Figure 3:
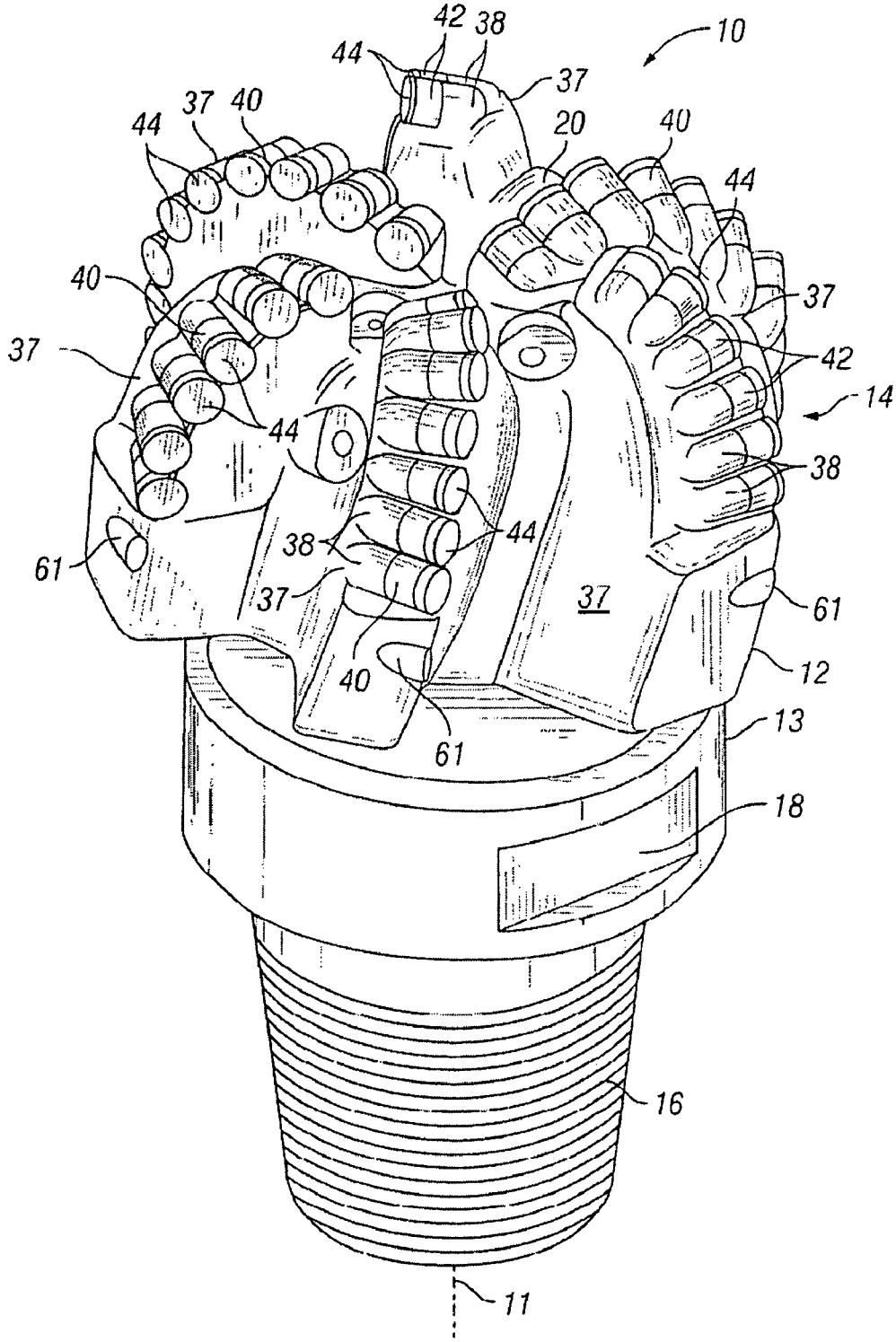
FIG. 3 (Prior Art)
FIG. 3 is an isometric view of a conventional drill bit.

A known drill bit is shown in FIG. 3. Bit 10 is a fixed cutter bit, sometimes referred to as a drag bit, and is preferably a PDC bit adapted for drilling through formations of rock to form a borehole. Bit 10 generally includes a bit body having a shank 13, and a threaded connection 16 for connecting bit 10 to a drill string that is employed to rotate the bit for drilling the borehole. Bit 10 further includes a central axis 11 and a cutting structure forming a cutting face 14 of the drill bit. The cutting structure includes various PDC cutter elements 40 with a backing portion 38 on a plurality of blades 37 extending radially from the center of the cutting face 14. Also shown in FIG. 3 are gage pads 12 and gage trimmers 61, the outer surface of which are at the diameter of the bit and establish the size of the bit. Thus, a 12" bit will have gage pads 12 and gage trimmers 61 at approximately 6" from the center of the bit.

Figure 4:
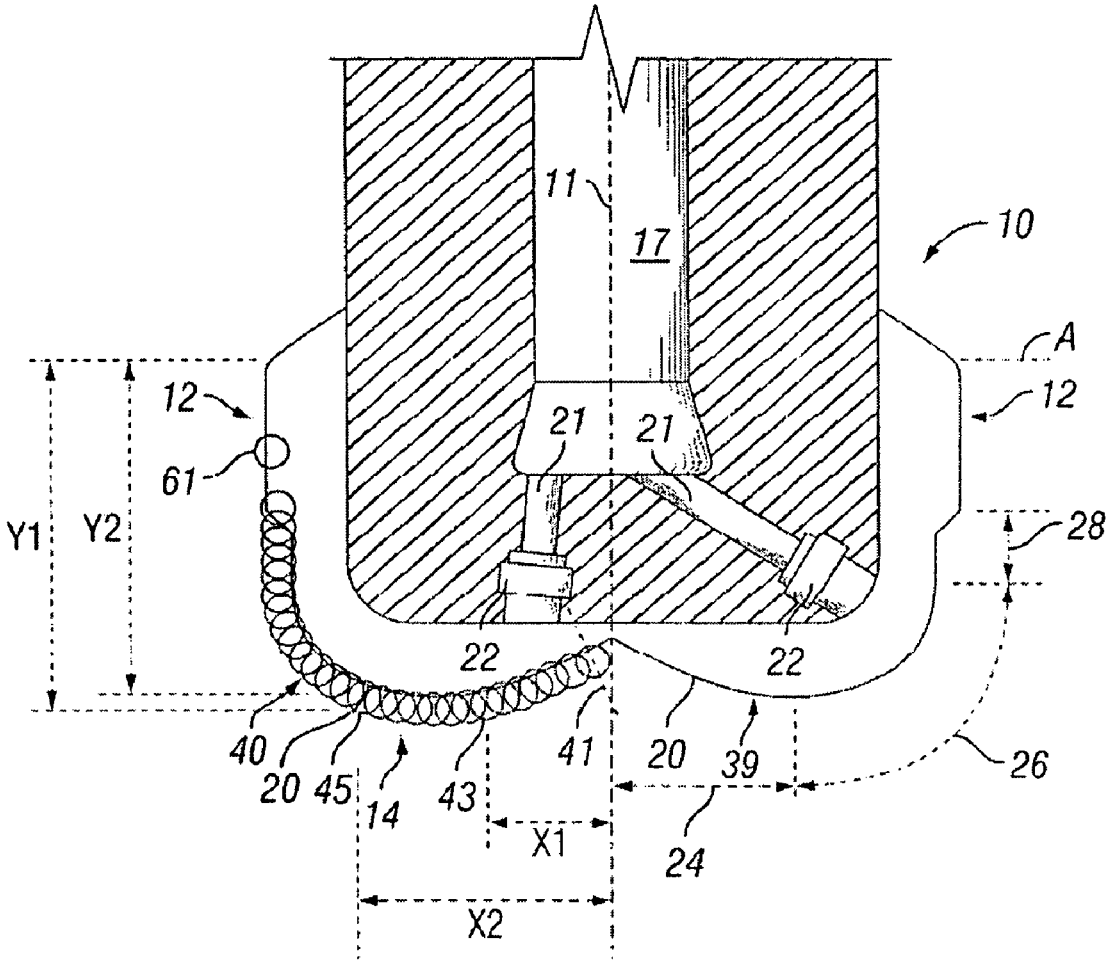
FIG. 4 (Prior Art)
FIG. 4 is a cut-away view of a conventional drill bit with cutting elements illustrated in rotated profile.

Referring now to FIG. 4, a cut-away view of bit 10 is shown as it would appear with all cutter elements 40 shown overlapping in rotated profile on the cutting face 14. The cutters 40 are positioned on the bit to cut through earth formation as the drill bit 10 rotates. Downwardly extending flow passages 21 have nozzles or ports 22 disposed at their lowermost ends. The flow passages 21 are in fluid communication with central bore 17. Together, passages 21 and nozzles 22 serve to distribute drilling fluid around the cutter elements 40 for flushing drilled formation from the bottom of the borehole and away from the cutting faces of cutter elements 40 during drilling. Amongst several other functions, the drilling fluid also serves to cool the cutter elements 40 during drilling.

Blade profiles 39 and bit face 20 can be divided into three different regions 24, 26 and 28. The central region of the bit face 20, called the "cone region," is identified by reference numeral 24 and is concave in this example. Adjacent the central region 24 is the shoulder or the upturned curve region 26. Next to the shoulder region 26 is the gage region 28 which is the portion of the cutting face 14 that defines the diameter or gage of the borehole being drilled. Cutter elements 40 are disposed along each of the blades in regions 24, 26 and 28.

As shown in FIG. 4, cutter elements 40 are located on the blades such that a center of each cutter element 40 is at a radial position that is a predetermined distance from longitudinal axis 11 and at an axial position that is a predetermined distance from a reference plane "A" that is perpendicular to longitudinal axis 11. For example, a specific cutter element 43 is located a distance X1 from longitudinal axis 11 and a distance Y1 from plane A, while cutter element 45 is located a distance X2 from longitudinal axis 11 and Y2 from plane A.

During drilling, every cutter on the bit in contact with earth formation generates forces such as a normal force, a vertical force, and a radial force. All of these forces have a magnitude and direction, and thus each may be expressed as a force vector. During the balancing of the bit, all of these force vectors are summed and a total imbalance force vector magnitude and direction can then be determined. The process of balancing a drill bit is the broadly known process of ensuring that the imbalance force vector is either eliminated, minimized, or is properly aligned.

The tendency of a bit to deviate predictably from straight-ahead drilling can be increased as the magnitude of an imbalance force vector increases as described for example in U.S. Pat. No. 5,937,958, which is assigned to the assignee of the present invention and incorporated herein by reference. Similarly, the tendency of a bit to deviate with dropping tendencies can be increased as the imbalance force approaches the middle of an active region as described for example in U.S. Pat. No. 6,308,790, which is also assigned to the assignee of the present invention and incorporated herein by reference. As discussed in the prior art, the magnitude of the imbalance force vector can be increased by manipulating geometric parameters that define the positions of the PDC cutters on the bit, such as back rake, side rake, extension height, angular position, and profile angle. Likewise, the desired direction of the imbalance force can be achieved by manipulation of the same parameters. In addition, a mass imbalance on the drill bit can also be achieved by distributing the mass of the drill bit in a nonsymmetrical manner, a methodology that is known to those skillful in the art.

Figure 5:
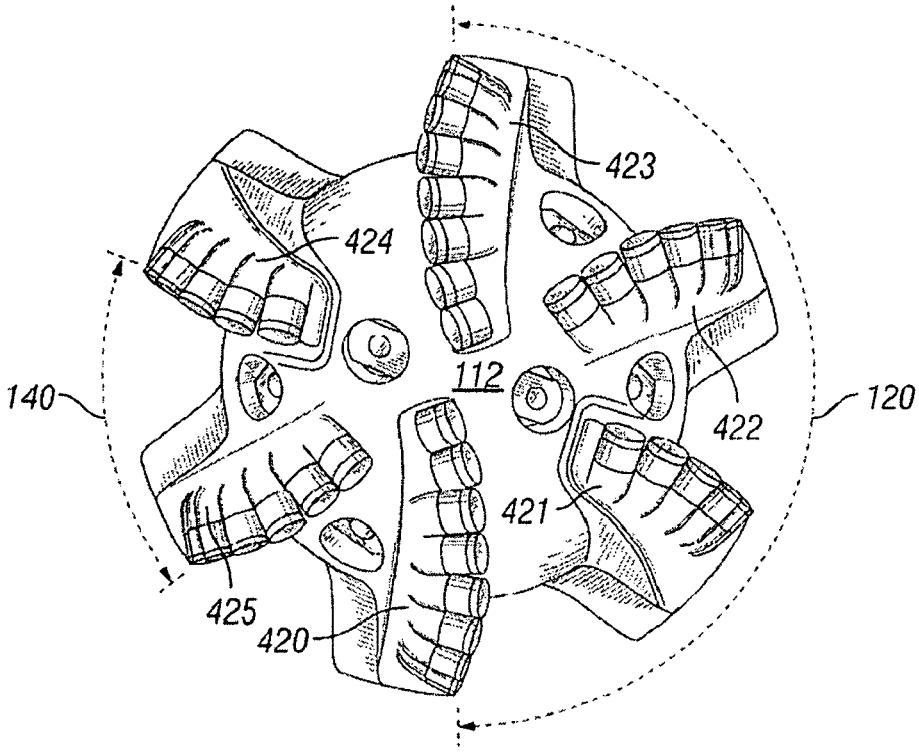
FIG. 5 (Prior Art)
FIG. 5 is a cutting face view of a prior art drill bit with dropping tendencies.

FIG. 5, shows one example of a prior art bit designed to have dropping tendencies. The bit includes an active zone 120 and a passive zone 140. Active zone 120 is defined as the portion of the bit face extending from blade 420 to blade 423 and including the cutters of blades 420, 421, 422 and 423. Passive zone 140 is generally defined as the portion of the bit face extending from blade 424 to blade 425 and includes the cutters of blades 424 and 425. To produce a bit with dropping tendencies, the cutters in the active zone 120 are positioned on the bit to drill earth formation more aggressively than the cutters in the passive zone 140. This may be done by manipulating parameters such as the relative back rake, side rake, extension height, and profile angle between the cutters in the active zone 120 and the passive zone 140. As a result, the forces on cutters in the active zone will 120 be greater than the forces on cutters in the passive zone 140. The resulting force vectors can be determined and summed as known in the art to determine the resulting imbalanced force vector on the bit.

In addition, cutters in the passive zone 140 are typically positioned in redundant radial locations with respect to cutters on a blade in the active zone 120 so that forces on the blades in the passive zone 140 are further reduced. Blades in the passive zone 140 and their corresponding gage pads also are typically configured to extend to less than the full radius of the bit so that a difference in radii exists between the passive and active zones of the bit. This causes the drill bit to shift to the active zone side of the bit in a deviated borehole when the passive blades 424 and 425 lie in positions that are close to the high side of the borehole. This feature may also contribute to an uneven mass distribution between the active zone 120 and the passive zone 140 which can further accentuate the dropping tendency of the drill bit.

Figure 6:
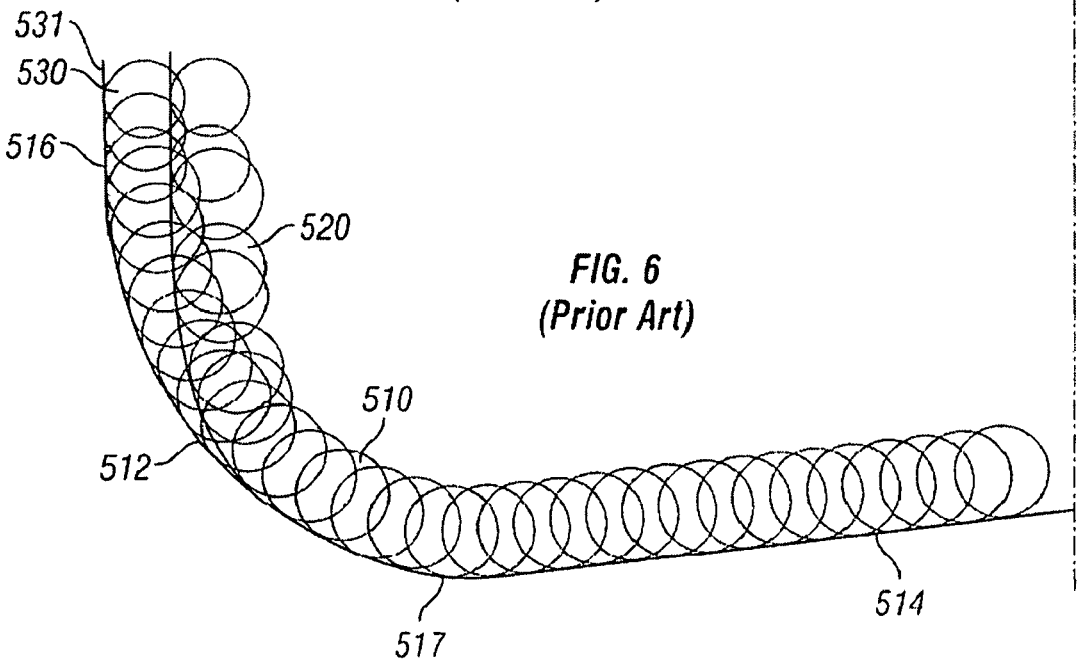
FIG. 6 (Prior Art)
FIG. 6 is a rotated profile view of cutters mounted on the drill bit shown in FIG. 4.

A rotated profile of the bit shown in FIG. 5 is shown in FIG. 6. Referring to FIG. 6, the radial position of each cutter on the drill bit is shown. The cutting face includes a cone region 514, gage region 516 and a shoulder region 512 therebetween. The lowest most point (as drawn) on the cutter tip profiles defines the bit nose 517 which generally lies in the shoulder region 512. It can be seen that certain cutters, although at differing axial positions (as shown in FIG. 5) may occupy similar radial position to other cutters on other blades of the bit. Cutting profile 510, for example, corresponds to a single trough cut by multiple cutting elements on the bit. Multiple cutters that correspond to essentially a single trough are referred to as "redundant." Additionally, cutting elements at the far radial ends of the blades in the active region (120 in FIG. 5) are positioned to cut troughs that extend to the full diameter, or "gage," of the drill bit, such as corresponding to cutting profile 530. Cutting tips of cutting elements located in the passive region are recessed from the active cutting element profiles in the shoulder and gage regions 512, 516 and do not extend to the full diameter, or "gage," of the drill bit, such as corresponding to cutting profile 520.

As discussed in the background section herein, prior art bits having cutting elements in passive regions "pulled off profile" or recessed relative to cutters in active regions can produce dropping tendencies desired in many drilling applications without requiring additional directional drilling equipment. However, these designs also result in a reduced numbers of cutters for active engagement with earth formation during drilling which limits the durability and drilling life of the bit.

In accordance with an aspect of the present invention, the performance of bits with dropping tendencies can be improved by providing back up cutters on one or more blades in an active region that have cutting tips extending to the primary cutting profile to compensate for cutting elements on one or more blades in the passive region that are recessed from the primary cutting profile of the bit. Bits designed in accordance with this and/or other aspects of the present invention described below provide increased the cutter tip density along the primary cutting profile of the bit for increased durability and increased bit life.

Figure 7:
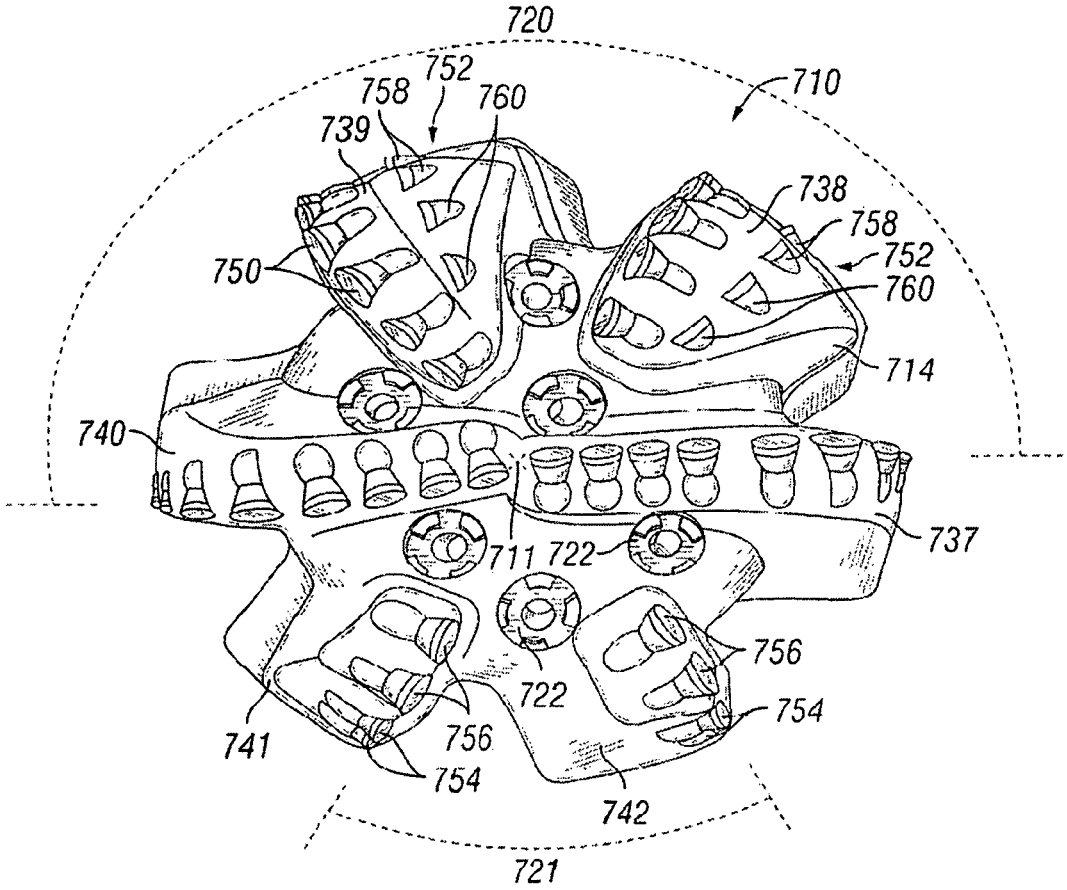
FIG. 7 is a cutting face view of a bit in accordance with one embodiment of the present invention.

FIG. 7 shows one example of a bit designed in accordance with various aspects of the present invention. As shown in FIG. 7, the bit 710 includes a cutting face 714 having a plurality of blades 737-742 projecting from cutting face 714 and extend radially outward from a bit axis 711. Blades 737-742 have a plurality of cutter elements 750 mounted thereon at varying radial and axial positions for engaging and cutting through earth formation as the bit is rotated. The cutting elements 750 are generally arranged in rows along each blade. Bit 710 further includes a plurality of nozzles 722 positioned between the blades to distribute drilling fluid as described above. The arrangement and locations of the cutter elements 750 shown in bit 710 are for purpose of example only. Other embodiments may have different arrangements of cutter elements, including, for example, different numbers of blades and/or blades that are more or less curved than those shown in FIG. 7.

Referring to FIG. 7, blades 737-740 of the bit 710 generally define an active region 720 of the bit 710 and blades 741 and 742 generally define a passive region 721 of the bit 710. The active region spans about 180 degrees. The passive region spans around 60 degrees. While the bit 710 is generally described as including an active region 720 and a passive region 721, all of the cutting elements in the passive region 721 may not be "passive" or recessed, and all of the cutting elements in the active region 720 may not be "active". The term "active" cutting element will be used herein to refer to a cutting element on the bit that has a cutting tip that extends to form a primary cutting profile of the bit. The term "passive" or "recessed" cutting element will be used herein to refer to a cutting element that is positioned on the bit with its cutting tip recessed from the primary cutting profile of the bit. For example, referring to the cutting profile shown in FIG. 6, cutting element 530 is active and cutting element 520 is passive or recessed. The primary cutting profile is indicated as 531.

Referring again to FIG. 7, in this example, blade 740 leads the active region 720 and its cutters in the cone and shoulder regions are non-redundant with respect to the cutters on any of the other blades. Blade 737 is the most lagging blade of the active region 720 and its cutters in the cone and shoulder regions are also non-redundant with respect to the cutters on any of the other blades. Blade 738 and blade 739 are intermediate blades in the active region 720 and their leading edge cutters are also preferably non-redundant with respect to the cutters on any other blade in the cone and shoulder regions.

Additionally, each of the blades 737-740 in the active region 720 includes a plurality of cutters 750 arranged proximal the leading edges of the blade which are positioned to actively function and cut earth formation as the bit is rotated. Each of the blades 741-742 in the passive region 721 includes one or more active cutting elements in an inner region (e.g., 624, 625 and 626 in FIG. 8) of the bit which are positioned to actively cut earth formation as the bit is rotated, and one or more passive cutters positioned toward an outer region (e.g., 626 and 628 in FIG. 8) of the bit to passively engage formation when the bit is rotated.

In accordance with an aspect of the present invention, the bit 710 further includes a plurality of back up cutters 752 on blades 738 and 739 in the active region 720 which are positioned at radial locations so that they overlap in rotated profile with cutting elements positioned on blades 741 and 742 in the passive region 721 of the bit. Selected ones of the back up cutters 752 are positioned to have cutting tips that extend to the primary cutting profile of the bit to compensate for cutting elements in the passive region 721 of the bit which have been pulled off profile and are recessed from the primary cutting profile (shown in FIG. 8). Placing active back up cutters on blades in the active region to compensate for passive cutters pulled off profile allows for increased cutter tip density along the bit profile in areas where the bit would otherwise be prone to excessive cutter wear and/or impact loading. This is better seen in FIG. 8 which shows increased cutter density along the primary cutting profile 630 in the nose, shoulder and gage regions 625, 626, 628 of the bit (as compared to FIG. 6). Placing active backup cutters on blades also reduces the loading placed on other active cutters during drilling and, advantageously, can result in enhanced side cutting capability and dropping tendency for the bit.

In the particular embodiment shown, blades 741 and 742 in the passive region 721 include a plurality of active cutting elements 756 along the cone and shoulder regions of the cutting face 714 and a plurality of passive cutting elements 754 along the shoulder and gage regions of the cutting face 714. The active cutting elements 756 on blades 741 and 742 in the passive region 721 are positioned to extend to the primary cutting profile of the bit to provide increased cutter tip density along the shoulder region of the bit where prior art dropping bits have been found to suffer excessive wear. Active cutting elements 756 in the passive region 741 are also positioned in unique radial positions with respect to other cutting elements on the bit to increase the number of unique cutter positions in contact with earth formation during drilling. This arrangement decreases the amount of normal force on each active cutter and can also reduce the arc length of adjacent cutters in contact with earth formation. This can result in reduced wear on active cutters during drilling, increased impact resistance, and increased bit life.

The passive cutting elements 754 on blades 741 and 742 in the passive region 721 are positioned to extend to a secondary cutting profile 620 that is recessed from the primary cutting profile of the bit by a selected amount to reduced forces on the blades in the passive region 721. This is done so that an imbalanced radial force will result during drilling to enhance the dropping tendencies of the bit. Selected passive cutting elements 754 in the passive region 721 are also positioned in unique radial positions with respect other cutting elements on the bit 710. This may be done to position sharp tips of passive cutting elements 754 in locations so that they will engage with ridges of earth formation formed between adjacent cutting element paths cut by active cutters as they become worn during drilling.

Blades 741 and 742 in the passive region 721 are also configured to extend to less than the full radius of the bit. Thus, a difference in radii exists between the blades 741-742 in the passive region 721 and the blades 737-740 in the active region 720. This results in a bit that will tend to shift to the active region side of the bit in a deviated borehole when the passive blades 741 and 742 lie in positions that are close to a high side of the borehole. This feature also contributes to an uneven mass distribution between the active region 720 and the passive region 721 which further accentuates the dropping tendency of the drill bit.

As noted above, active back up cutter elements 758 are positioned on blades 738-739 in the active region 720 to generally corresponding to radial locations of passive cutters 754 that have been pulled off profile in the passive region 721. The active back up cutters 758 have cutting tips that extend to the primary cutting profile of the bit. The active back up cutters 758 are placed on blades 738 and 739 in positions that radially overlap with passive cutters 754 on blades 741 and 742 when viewed in rotated profile. This arrangement permits an increase in the cutter tip density along the nose, shoulder and gage regions (625, 626, 628 in FIG. 8) of the bit. By positioning active back up cutters 758 as described, work normally done by cutters 754 (if placed on profile) in the passive region 721 can be transferred to back up cutters in the active region so that the diamond density of a full bladed bit is substantially maintained even though cutters on blades in the passive region 721 have been pulled off profile to create a bit with desired dropping tendencies. This reduces the mount of work required by the other active cutters in the shoulder and gage regions and results in reduced wear on active cutters during drilling. This also permits increased side cutting capability and dropping tendency for the bit, such that it may be able to achieve or maintain a more narrow vertical target than prior art bits without the need for additional directional drilling equipment.

Blades 738 and 739 in the active region 720 also have increased circumferential width as compared to the blades 741 and 742 in the passive region 721 to permit the placement of back up cutters 752 on the blades 738, 739. Having wider blades in the active region 720 versus the passive region 721 also permits greater uneven mass distribution for the bit which helps the bit shift to the active region side of a deviated borehole when the passive blades 741-742 are in positions on the high side of the borehole.

Figure 8:
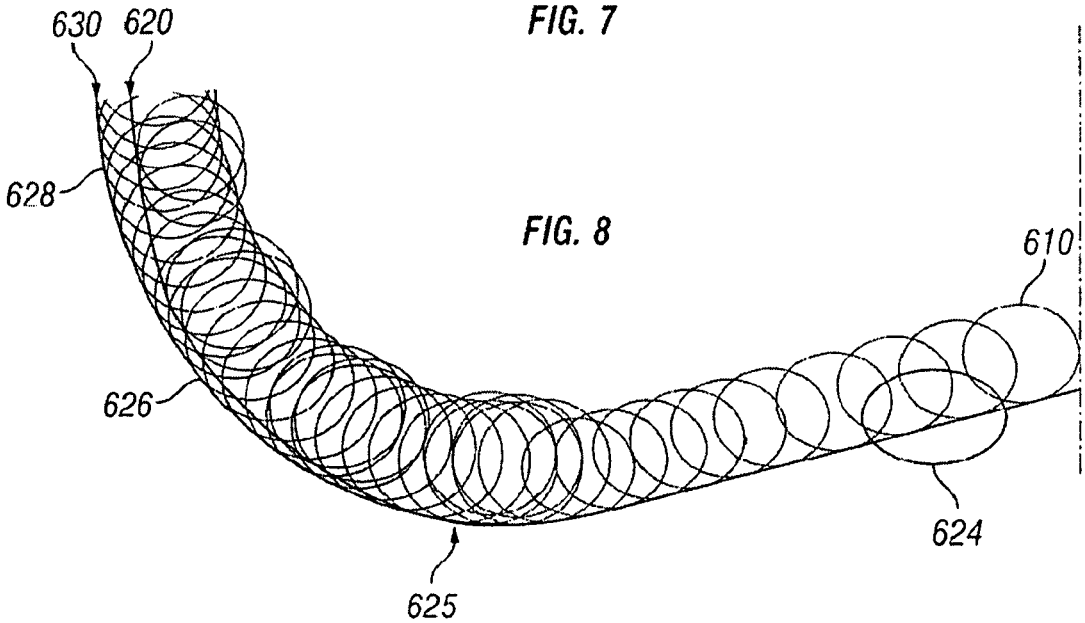
FIG. 8 is a rotated profile view of cutters mounted on the drill bit shown in FIG. 7.

Passive back up cutters 760 may also be positioned on blades 738 and 739 in the active region 720 at radial locations, that generally correspond to radial locations of active cutting elements 756 in the passive region 721. The cutting tips of the passive back up cutters 760 in the active region 720 are positioned to extend to the secondary cutting profile 620 and are disposed at unique radial positions that overlap with active cutting elements 756 in the passive region 721 when viewed in rotated profile (as shown in FIG. 8). As the active cutting elements 756 become worn during drilling, these passive back up cutters 760 will generally start to engage ridges of earth formation formed between adjacent active cutters that intersect their path.

For the bit in FIG. 7, by providing active cutters 756 in the inner region (cone and shoulder regions) of the passive region 721 along with active back up cutters 758 in the outer region (i.e., shoulder and gage regions) in the active region 720, the number of unique cutter positions contacting the bottom hole during drilling is increased and wear on active cutters in the shoulder and gage regions of the bit is reduced while still achieving a robust bit design having desired dropping tendencies.

While the example embodiment discussed above has been described as generally comprising a single set bit configuration (with cutters generally positioned at unique radial positions), it will be appreciated that in other embodiments the cutters may be arranged in any configuration desired, such as in a plural set configuration (with redundant cutter locations) or a mixed single set/plural set configuration (with some cutters in unique radial locations and others in redundant locations) as is known in the prior art. Thus, in one or more embodiments, cutting elements on one or more of the blades in the passive region may be positioned in redundant radial locations to cutting elements on other blades of the bit. Similarly, one or more of the backup cutters positioned in an active region may be positioned in a redundant radial location to another cutting element on a blade of the bit. However, in or ore more preferred embodiments, each blade in the active region may support cutting elements wherein a majority of the cutting elements are positioned at unique radial locations with respect to other cutting elements on the bit to provide increased cutter contact and bottomhole coverage for the bit as it drills.

In one or more embodiments, preferably blades in the passive region include one or more active cutters as well as one or more recessed cutters which are recessed from the bit profile, particularly in the shoulder and/or gage region. These passive cutters may be positioned in redundant or non-redundant radial locations with respect to cutter elements on other blades of the bit. In a preferred embodiment, one or more of the recessed cutters in the passive region may also have a unique radial position with respect to other cutting elements on the bit.

By placing non-redundant cutters on each of the blades in the active region, and on at least one of the blades in the passive region, the overall drilling aggressiveness of the bit is made more pronounced. By placing passive cutters on portions of the blades in the passive region 721, larger cutting forces and drilling torque will result in the active region of the drill bit versus the passive region of the drill bit can result.

It should be appreciated that the manner in which the active cutters are more active in drilling than the passive cutters can be achieved by a number of design criteria such as cutter extension height, cutter rake angle, and/or angular distance between redundant blades as is known to those skilled in the art.

Further, cutters disposed in an active region of the bit need not be limited to being more aggressive than cutters placed in passive regions of the bit to generate a total imbalance force desired. Rather, in one or more embodiments selected cutting elements in both the active and passive regions of the bit may have back rakes and extension heights that are substantially the same. For example, in one embodiment, such as the one shown in FIG. 7, the average back rake on active cutters in both the active and passive regions 720, 721 of the bit may be about 20 degrees along the majority of the profile of the bit. Providing similar aggressiveness for active cutters in the passive region 721 and active region 720 establishes a more equal distribution of force, impact, and wear on the active cutters.

Similarly, the relative side rake, height, and profile angle between active cutters in the active region and active cutters in the passive region at similar radial locations may be the same in aggressiveness. For example, cutting elements may be positioned on the bit such that their back rakes and/or side rakes gradually increase, or increase in steps, with radial distance from the longitudinal axis of the bit. For example, in one embodiment, such as the one shown in FIG. 7, cutters in the cone region may be set at a higher back rake than cutters in the shoulder and gage regions to minimize problems associated with cutter breakage and cutter loss in the cone region.

In other embodiments, cutting elements in passive regions of the bit may be positioned to have back rake angles that are more or less aggressive than back rake angles provided for active regions of the bit to provide cutters in active regions that drill formation more or less aggressively than cutters in passive regions. In preferred embodiments, such values will be selected dependent on bit size, the number of blades on the drill bit, the number of cutters, and the hardness and drillability of the rock to be drilled. In such case, the resulting force vectors may be determined and summed as known in the art. Iterative adjustment of these criteria results in a drill bit having an active region and a passive region with a more even distribution of forces on the cutters and more evenly distributed workloads on the cutters, while still providing a bit having a total imbalance force vector directed generally midway through the active region and configured to achieve desired dropping tendencies (when viewed in the cutting face plane perpendicular to the bit axis).

As is known in the art, back rake may generally be defined as the angle formed between the cutting face of the cutter element and a line that is normal to the formation material being cut. Thus, with a cutter element having zero back rake, the cutting face is substantially perpendicular or normal to the formation material. Similarly, the greater the degree of back rake, the more inclined the cutter face is and therefore the less aggressive it is.

Additional features may also be implemented for selected applications to minimize problems associated with cutter breakage and/or cutter loss in cone and nose regions of a bit. For example, in one or more embodiments, cutters having different diameters may be used on a bit in different regions of the bit to provide more even load distributions, on cutters for increased durability and bit life. This is shown for example in FIGS. 7 and 8, wherein the smaller cutters 610 are placed in the cone region (624 in FIG. 8) of the bit to help reduce high forces typically seen on cutters positioned in the cone region. Using smaller cutters in the cone region allows for the placement of more cutters in the cone region. This can be done to provide increased cutter density in the cone region near the center of the bit to reduce loading on the center cutter which typically sees the highest loading. Providing increased cutter density also reduces the cutter shear length (cutting tip arc length) in contact with earth formation during drilling. The arc length of a cutter in contact with earth formation is generally defined by the intersecting arc of adjacent cutters, as best seen in the profile view shown in FIG. 8. By reducing loading on cutters in the cone region of the bit, the potential for premature cutter breakage and/or cutter loss in the cone region will be reduced. In many applications, this will result in a bit that can drill longer before having to be pulled to the surface.

Other factors that may be manipulated to influence the bit's dropping tendency is the relationship of the blades and the manner in which they are arranged on the bit face, as further discussed in the art incorporated herein by reference. Some important angles worth noting for bit designs include those between blades 737 and 740 in the active region 720 and those between blades 741 and 742 in the passive region 721. In one or more embodiments, the active region 720 preferably spans 120 degrees to 220 degrees, and more preferably 180 degrees or less. The passive region 721 spans 160 degrees or less and, more preferably, 120 degrees or less. In any case, the angle of passive region 721 will be smaller than that of active region 720.

The larger the angle between the leading and trailing blades 740 and 737 in the active region 120, the greater the angular spread of the torque generated by the active side of the bit and the larger the total imbalance force. However, providing an active region that spans less than 180 degrees may allow for an increase in the dropping tendency of the bit due to reduced geometric constraints. This may also increase the mass imbalance of the bit. In one embodiment, the blades in the passive region are no more than 100 degrees apart. However, it should be appreciated that in other embodiments, the preferred angle spanned by blades in the passive will depend on the bit size and number of blades in the bit design.

Asymmetric gage pads also may be used to enhance the dropping tendency of a bit. In other embodiments, one or more gage pads provided on the bit may alternatively or additionally be tapered, such as tapered in an axial direction away from the bit face, to enhance the dropping tendency of the bit.

Referring again to FIG. 7, each blade 737-742 ends at its outermost radius at a gage pad, with a radius r being measured for each gage pad from the longitudinal axis 711 of the bit. In accordance with a preferred embodiment, the radii $r_{741}$ and $r_{742}$ of the gage pads on blades 741 and 742 in the passive region 721 are less than the radii $r_{737}$, $r_{738}$, $r_{739}$, and $r_{740}$ of the gage pads on blades 737, 738, 739, 740. The difference between $r_{741}$, $r_{742}$ and $r_{741}$, $r_{742}$ will depend on bit size but is preferably at least 0.125 inches. In particular embodiments, this amount may be around 1 inch for a 14¾ inch bit and around ¾ inch for 12¼ inch bit. This difference in blade lengths and drill bit radii between the passive and active regions causes the drill bit to shift to the active region side of a deviated borehole when blades 741 and 742 lie in positions that are close to the high side of the hole. This encourages the dropping tendency of the drill bit.

Directional bits designed in accordance with one or more aspects of the present invention may provide increased durability and reduced wear compared to prior art directional bits. As a result, these bits are more likely to be in a better dull condition when pulled. This increases the likelihood of a repairable bit being pulled after an initial drilling run which can be reused for a subsequent run. Thus, increasing the durability of a directional bit in accordance with one or more aspects of the present invention can also result in a significant economic benefit to customers and bit manufactures.

A bit designed in accordance with the embodiment shown in FIGS. 7 and 8 was analyzed and compared against a prior art bit designed in accordance with the example shown in FIGS. 5 and 6. Based on that analysis, one or more of the following advantageous benefits may be obtained by using a bit in accordance with aspects of the present invention: A 50% increase in footage drilled may be obtained before wearing cutters down to a 0.045 inch wear flat. A 24% decrease in normal forces on the cutters in the cone region of the bit may be achieved. A more even distribution of normal force on the active cutters during drilling may be seen. A lower normal force per radial cutter position may seen, especially for cutters in a central region of the bit. A 10 to 15% increase in rate of penetration (ROP) of the bit may be achieved. A 60% increase in the drilling life of the bit may be achieved.

In view of the above description, it will appreciate that in other embodiments may be achieved by adding one or more back up cutters on one or more blades in an active region of a bit designed to have dropping tendencies to provide increased cutter density, increased bottom hole coverage, reduced work load on active cutters, reduced normal and/or vertical forces on active cutters, a more even load distribution on active cutters, increased side cutting capability, increased dropping tendency, enhanced durability and/or increased bit life. In accordance with preferred embodiments, the cutting structure of a bit is preferably arranged to provide a total imbalance force for the bit that is generally directed toward the center of the active region of the bit (when viewed in a bit face plane).

Those skilled in the art will also appreciate that variations may be made to the disclosed embodiment and still be within the scope of the present invention. For example, blades with passive cutters can be added to the active region and still fall within the scope of the present invention so long as the active region on the whole remains dominant in cutting to the passive region, and so long as the total imbalance force vector remains directed through the active region of the bit. Additionally, a drill bit with dropping tendencies may be built having fewer than all the features disclosed herein. Further, the drill bit may have more, or fewer, blades than the drill bit described herein. Further, cutters in the active region and passive region may be positioned to have similar or different rake angles as desired. It will also be appreciated that the teachings herein can be applied to drill bits other than a PDC bit, including natural diamond and diamond impregnated drill bits.

By providing one or more features described above to bits having dropping tendencies, the dropping tendency of an existing directional bit can be improved. As a result, such bits will be better able to drill within narrow vertical targets without the use of directional drilling tools. This can lead to significant cost savings for a particular drilling operation.

While the invention has been described with respect to a limited number of embodiments, those skilled in the art, having benefit of this disclosure, will appreciated that numerous other embodiments can be devised which do not depart from the scope of the invention as disclosed herein. Accordingly, the scope of the invention should be limited only by the attached claims.

What is claimed is:

1. A drill bit having dropping tendencies, comprising:

a bit body having a longitudinal axis, a bit face, and a primary cutting profile, the bit face generally comprising an active region and a passive region;

a plurality of cutters disposed on the bit face to cut through earth formation as the bit is rotated about the longitudinal axis, the plurality of cutters comprising:

a plurality of active cutters in the active region;

a plurality of active cutters in the passive region;

wherein each active cutter includes a cutting tip extending to the primary cutting profile;

wherein each active cutter in the passive region is disposed at a unique radial position with respect to every other cutter on the bit face;

a plurality of passive cutters in the passive region;

wherein each passive cutter includes a cutting tip that is recessed from the primary cutting profile;

a first plurality of backup cutters in the active region, wherein each of the first plurality of backup cutters includes a cutting tip extending to the primary cutting profile;

wherein each backup cutter is disposed behind one of the active cutters in the active region; and wherein the plurality of cutters are positioned on the bit such that an imbalance force vector exists on the bit when used to drill though earth formation.

2. The drill bit of claim 1, further comprising:

a plurality of blades on the bit face, the plurality of cutters being generally arranged in rows on the blades, the active region being generally defined by a first set of consecutive blades on the drill bit and the passive region being generally defined by a second set of consecutive blades on the drill bit, wherein one or more of the plurality of active cutters in the active region and one or more of the plurality of backup cutters in the active region are disposed on the same blade in the active region.

3. The drill bit of claim 2, wherein each of the blades in the active region and the passive region extends a length measured from the longitudinal axis, the length for the blades in the passive region being less than the length of the blades in the active region.

4. The drill bit of claims 3, wherein the imbalance force vector is angularly directed toward an approximate middle of the active region.

5. The drill bit of claim 2, wherein selected blades in the first set of blades have a circumferential width that is greater than the circumferential width of selected blades in the second set of blades.

6. The drill bit of claim 2, further comprising:

a gage pad corresponding to each of the blades in the active region; and a gage pad corresponding to each of the blades in the passive region;

wherein one or more of the gage pads in the active region includes a cutter elements positioned to provide side cutting.

7. The drill bit of claim 1, wherein one or more of the active cutters in the active region are positioned along an inner region of the bit and one or more of the passive cutters in the passive region are positioned along an outer region of the bit.

8. The drill bit of claim 1, wherein the passive cutters have unique radial positions with respect to the active cutters in the active region and the active cutters in the passive region.

9. The drill bit of claim 8, wherein the plurality of backup cutters includes cutters having unique radial positions with respect to the active cutters in the active region, the active cutters in the passive region, and the passive cutters in the passive region.

10. The drill bit of claim 1, further comprising a second plurality of back-up cutters positioned in the active region;

wherein each of the second plurality of backup cutters includes a cutting tip that is recessed from the primary cutting profile; and wherein each of the first plurality of backup cutters overlaps with one of the passive cutters in the passive region in rotated profile; and wherein each of the second plurality of backup cutters overlaps with one of the active cutters in the passive region in rotated profile.

11. The drill bit of claim 10, wherein the cutting tips of the passive cutters in the passive region and the second plurality of backup cutters form a secondary cutting profile recessed from the primary cutting profile.

12. The drill bit of claim 1, wherein one or more of the active cutters in the active region and one or more of the active cutters in the passive region have substantially the same back rake angle.

13. The drill bit of claim 1, wherein the drill bit has an uneven mass distribution with increased mass in the active region with respect to the passive region.

14. The drill bit of claim 1, wherein the active region spans less than 180 degrees and the passive region spans less than or equal to 120 degrees.

15. The drill bit of claim 1, wherein at least one of said plurality of cutters located in a cone region of the bit is smaller than one of said plurality of cutters located in an outer region of the bit.

16. The drill bit of claim 1, wherein the plurality of cutters are arranged to produce an imbalance force vector having a magnitude of from about 10 to about 40 percent of a weight on bit.

17. A method for assembling a drill bit with dropping tendencies, comprising:

a) placing a plurality of active cutters on a first plurality of blades in an active region on the drill bit which covers a first angular portion of the drill bit, wherein each active cutter in the active region is positioned in a unique radial position with respect to every other cutter on the drill bit, and wherein each active cutter is positioned to include a cutting tip extending to form a primary cutting profile of the bit;

b) placing a plurality of active cutters on a second plurality of blades in a passive region on the drill bit that covers a second angular portion of the drill bit;

c) placing a plurality of passive cutters on the second plurality of blades, wherein each passive cutter includes a cutting tip that is recessed from the primary cutting profile of the bit, wherein at least one of the passive cutters on the second plurality of blades is positioned in a unique radial position with respect to the active cutters on the first plurality of blades and the active cutters of the second plurality of blades;

d) placing a first plurality of backup cutters on at least one of the first plurality of blades, wherein each backup cutter is positioned behind one of the active cutters on the same blade, wherein each of the first plurality of backup cutters includes a cutting tips extending to the primary cutting profile of the bit, and wherein each of the first plurality of backup cutter elements is positioned to generally overlap with one or more of the passive cutters on the second plurality of blades when viewed in rotated profile.

18. The method of claim 17, wherein the plurality of cutters are positioned on the bit such that an imbalance force vector directed generally toward the axial center of the active region exists on the bit when used to drill through earth formation.

19. The method of claim 17 wherein one or more of the active cutters on the first plurality of blades and one or more of the active cutters on the second plurality of blades comprise back rake angles that are substantially the same.

20. The method of claim 17, wherein one or more of the first plurality of blades extends a first length from a longitudinal axis of the bit and one or more of the second plurality of blades extends a second length from the longitudinal axis, and the second length is less than the first length.

21. The method of claim 17, wherein an angular extension of the active region is approximately 120 degrees to 220 degrees.

22. The method of claim 21, wherein the angular extension of the active region is less than 180 degrees and the angular extension of the passive region is approximately 120 degrees or less.

23. The method of claim 18, wherein the imbalance force vector is from about 10 to about 40 percent of the weight on bit.

24. A drill bit for drilling a borehole comprising:

a bit body with a first end, a second end and a longitudinal bit axis;

a first blade disposed on the first end of the bit body;

a first arrangement of cutters disposed along a leading edge of the first blade, the cutters having cutting tips extending to a primary cutting profile of the bit;

a second blade disposed on the first end of the bit body;

a second arrangement of cutters disposed along a leading edge of the second blade, wherein the second arrangement is unique with respect to the first arrangement, a first plurality of cutters in the second arrangement having cutting tips extending to the primary cutting profile of the bit, a second plurality of cutters in the second arrangement having cutting tips recessed from the primary cutting profile of the bit;

an arrangement of backup cutters disposed on the first blade, the arrangement of backup cutters being positioned behind the first arrangement of cutters, wherein a first plurality of the backup cutters on the first blade each have a cutting tip extending to the primary cutting profile of the bit and a second plurality of the backup cutters on the first blade each have a cutting tip that is recessed from the primary cutting profile of the bit;

wherein each backup cutter in the first plurality of backup cutters is positioned to overlap, in rotated profile view, with one of the second plurality of cutters in the second arrangement of cutters.

25. The drill bit of claim 24, wherein:

each cutter element comprises a generally planar face; and each of the cutters in the second plurality of cutters is recessed from the primary cutting profile of the bit by approximately 0.020 inches to 0.060 inches with respect to a line normal to the bit profile.

26. The drill bit of claim 24, wherein each backup cutter in the second plurality of backup cutters is positioned to overlap, in rotated profile view, with at least one of said first plurality of cutters in the second arrangement when viewed in rotated profile.

27. A drill bit having dropping tendencies, comprising:

a bit body having a longitudinal axis, a bit face, and a primary cutting profile, the bit face generally comprising an active region and a passive region;

a plurality of cutters disposed on the bit face, the plurality of cutters comprising:

a plurality of active cutters disposed alone the leading edge of each of a first plurality of blades in the active region;

a plurality of active cutters disposed along a leading edge of each of a second plurality of blades in the passive region, each of the plurality of active cutters in the passive region being positioned at a unique radial position with respect to the plurality of active cutters in the active region;

wherein each active cutter has a cutting tip extending to the primary cutting profile;

a plurality of passive cutters disposed along the leading edge of each of the second plurality of blades in the passive region;

wherein each passive cutter has a cutting tip that is recessed from the primary cutting profile;

a first plurality of backup cutters positioned on one or more of the first plurality of blades in the active region;

wherein each backup cutter is disposed behind one or more of the active cutters on the same blade in the active region;

wherein each of the first plurality of backup cutters has a cutting tip that extends to the primary cutting profile and is positioned to overlap, in rotated profile view, with at least one of the passive cutters in the passive region.

28. The drill bit of claims 27, wherein the plurality of cutters on the bit face are arranged such that an imbalance force vector exists on the bit when used to drill though earth formation and the imbalance force vector is angularly directed toward an approximate middle of the active region.

29. The drill bit of claim 27, wherein one or more of the plurality of passive cutters in the passive region has a unique radial positions with respect to the active cutters in the active region and the passive region.

30. The drill bit of claim 29, wherein one or more of the first plurality of backup cutters is disposed at a unique radial positions with respect to the plurality of active cutters in the active region, the plurality of active cutters in the passive region, and the plurality of passive cutters in the passive region.

31. The drill bit of claim 29, further comprising a second plurality of backup cutters on one or more of the the first plurality of blades in the active region, wherein each of the second plurality of backup cutters is positioned to overlap, in rotated profile, with at least one of the plurality of active cutters in the passive region and has a cutting tip that is recessed from the primary cutting profile.

32. The drill bit of claim 31, wherein the active cutters in the passive region and the second plurality of backup cutters are disposed on the bit face in an inner region of the bit and the passive cutters in the passive region and the first plurality of backup cutters are disposed on the bit face in an outer region of the bit.

33. The drill bit of claim 31, wherein the plurality of passive cutters in the passive region, the first plurality of backup cutters, and the second plurality of backup cutters are each disposed at a unique radial position with respect to other cutters on the bit face.

34. The drill bit of claim 27, wherein one or more of the plurality of active cutters in the active region and one or more of the plurality of active cutters in the passive region have substantially the same back rake angle.

35. The drill bit of claim 27, wherein at least one of the cutters disposed in a cone region of the bit has a greater back rake than cutters disposed in an outer region of the bit, and wherein at least one the cutters disposed in a cone region of the bit has a smaller diameter than one of the cutter disposed in an outer region of the bit.

36. The drill bit of claim 27, wherein the active region spans between 120 and 220 degrees and the passive region spans less than or equal to 120 degrees.

* * * * *